US005528882A

United States Patent [19]

Yamamoto

[11] Patent Number: 5,528,882

[45] Date of Patent: Jun. 25, 1996

[54] WRAP AROUND CASER

[75] Inventor: Hisashi Yamamoto, Kanazawa, Japan

[73] Assignee: Shibuya Kogyo Co., Ltd., Ishikawa-ken, Japan

[21] Appl. No.: 139,321

[22] Filed: Oct. 18, 1993

Related U.S. Application Data

[63] Continuation of Ser. No. 907,881, Jul. 1, 1992, abandoned.

[30] Foreign Application Priority Data

Jul. 5, 1991 [JP] Japan ..... 3-190838

[51] Int. Cl.[6] ..... B65B 11/08; B65B 35/30

[52] U.S. Cl. ..... 53/531; 53/207; 53/220

[58] Field of Search ..... 53/220–224, 228–232, 53/207, 247, 531, 535, 537, 543, 208

[56] References Cited

U.S. PATENT DOCUMENTS

| | | | |
|---|---|---|---|
| 1,902,734 | 3/1933 | Streng | 53/223 |
| 2,830,417 | 4/1958 | Ullman et al. | 53/221 X |
| 2,844,929 | 7/1958 | Ringler | 53/230 |
| 2,900,776 | 8/1959 | Anness | 53/228 X |
| 2,946,164 | 7/1960 | Potts et al. | 53/543 X |
| 3,327,450 | 6/1967 | Carter | 53/247 X |
| 3,327,453 | 6/1967 | Willbrandt et al. | 53/228 |
| 3,585,776 | 6/1971 | Euwe | 53/230 X |
| 3,601,951 | 8/1971 | Bargel | 53/247 X |
| 3,986,319 | 10/1976 | Puskarz et al. | 53/228 X |
| 4,463,541 | 8/1984 | Nowacki | 53/207 X |
| 4,905,456 | 3/1990 | Oloechea | 53/537 X |
| 4,930,290 | 6/1990 | Barker | 53/207 X |
| 5,060,455 | 10/1991 | Schmeisser | 53/247 X |

FOREIGN PATENT DOCUMENTS 59-134122 8/1984 Japan .

*Primary Examiner*—Linda Johnson

*Attorney, Agent, or Firm*—Skjerven, Morrill, MacPherson, Franklin & Friel

[57] ABSTRACT

A wrap around caser including a holding and moving robot is provided. The holding and moving robot holds a predetermined number of bottles collected in a collection station and moves the bottles onto a center section of a blank sheet located at a receiving station and in succession pushes the bottles and the blank sheet downward along a predetermined path defined in a folding station so as to have the blank sheet folded into the shape of a box-shaped case around the bottles. The bottles are not released until they are placed in the box-shaped case so that the casing operation is stable and may be carried out at an increased.

6 Claims, 1 Drawing Sheet

WRAP AROUND CASER

This application is a continuation of application Ser. No. 07/907,881, filed Jul. 1, 1992, now abandoned.

BACKGROUND OF THE INVENTION

1. Field of the Invention

This invention generally relates to a casing apparatus for placing a predetermined number of containers, such as bottles, in a carton box, and, in particular, to a so-called wrap around caser for placing a predetermined number of containers on a blank sheet which is then folded into a box to have the containers enclosed therein.

2. Description of the Prior Art

A wrap around caser is well known in the art and one such example is described in the Japanese Patent Laid-open Pub. No. 59-134122. As shown in this prior patent, in the prior art wrap around caser, articles, such as containers, are transported in a predetermined direction as riding on a conveyor belt and collected in a predetermined arrangement at a collection station. Then, the articles thus collected are moved onto the bottom or central section of a blank sheet which has been located onto a vertically movable table from a magazine housing a stack of blank sheets. The blank sheet typically has a central section, which is generally rectangular in shape and will define the bottom of a box when folded, and a flap section at each side of the central rectangular section, which can be folded to define a side wall of a box when folded. In this case, use may be made of a transport head which grabs the articles temporarily and move them onto the blank sheet. Then, a top pusher is moved downward and brought into contact with the top surfaces of the articles located on the vertically movable table, so that the table and also the articles and blank sheet placed thereon start to move downward. As the table moves downward along a predetermined path, the flap sections of the blank sheet are folded in a predetermined manner to define a box so as to wrap around the articles.

In the above-described prior apparatus, however, use is made of separate devices for moving the articles from the collection station onto the blank sheet on the table and for pushing the articles downward along a predetermined path to have the blank sheet folded in a predetermined manner, so that the articles are not continuously held during these steps. In other words, the articles must be set in a free state once they have been placed on a blank sheet on the table. Because of this, the articles are set in a rather unstable condition so that the articles may shift in position or fall down in some cases. This has been a hindrance in increasing the speed in such a wrap around caser. In addition, because of the provision of such separate components along a process line, the overall system tends to be large and provision must be made of a means for synchronizing these separate components, which is not economical.

SUMMARY OF THE INVENTION

In accordance with the present invention, there is provided a wrap around caser comprising: a collection station for collecting articles, which are being transported by transporting means along a predetermined path, in a predetermined arrangement; supplying means for supplying a blank sheet of predetermined shape to a receiving station one by one from a storing station storing a number of blank sheets; and holding and moving means for holding a predetermined number of said articles at said collection station and moving said articles first onto a predetermined portion of said blank sheet at said receiving station and then along a predetermined path so as to have said blank sheet folded in a predetermined manner to have said articles wrapped by said blank sheet so folded.

In this manner, in accordance with the principle of the present invention, since a predetermined number of articles, such as containers like bottles, are positively held by the holding and moving means while the articles are placed on a blank sheet and wrapped around by the blank sheet, there is no possibility of causing instability to the articles during the process. Thus, the wrapping process speed can be increased without problem. Moreover, since separate components are not required the overall structure and operation can be simplified significantly.

It is therefore a primary object of the present invention is to provide an improved wrap around caser.

Another object of the present invention is to provide an improved wrap around caser simple and compact in structure, stable, and reliable in operation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
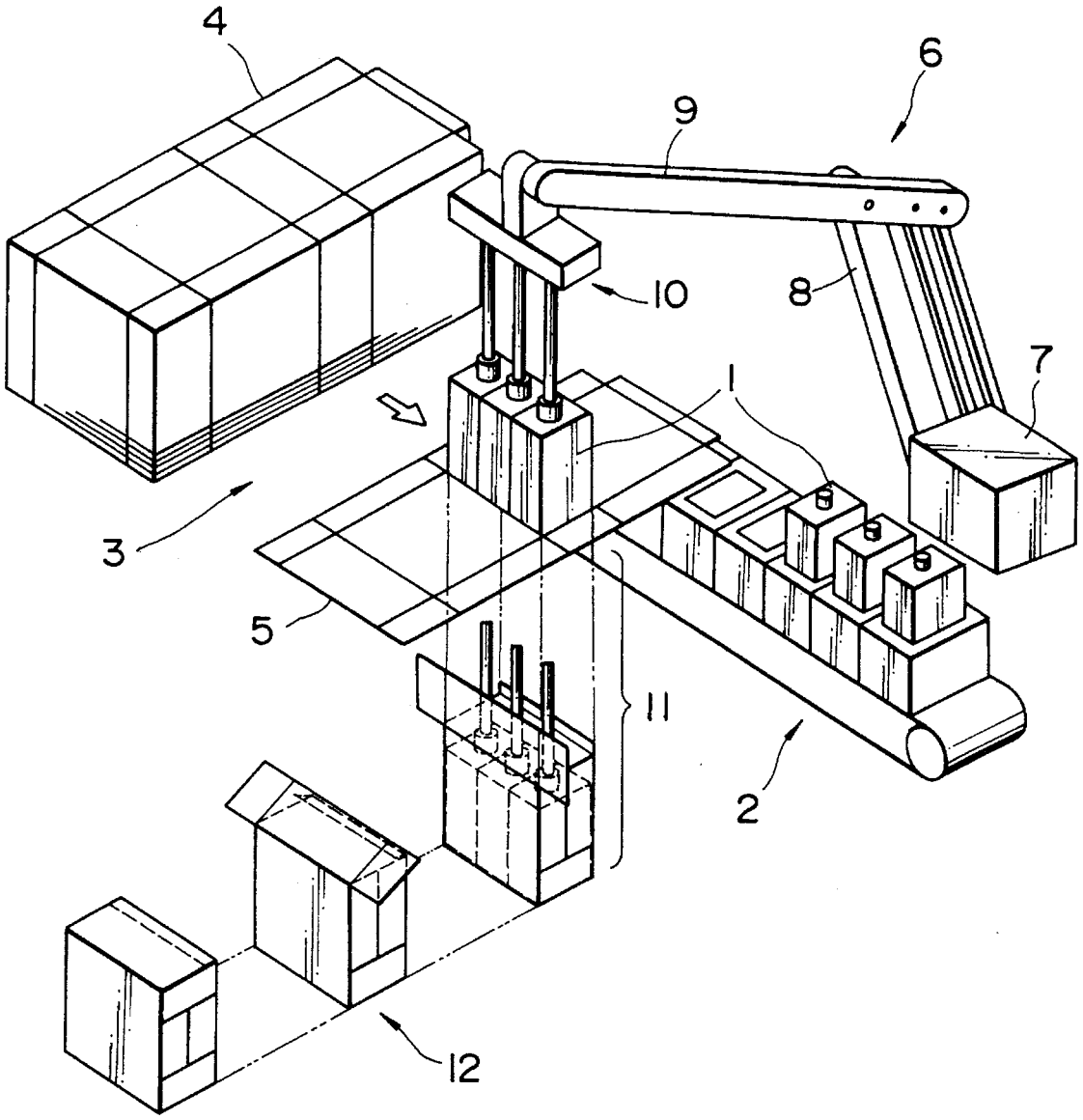
FIG. 1 is a schematic illustration showing in perspective view a wrap around caser constructed in accordance with one embodiment of the present invention.

Referring now to FIG. 1, there is schematically shown a wrap around caser constructed in accordance with one embodiment of the present invention. As shown, articles 1 such as bottles are being transported along a predetermined path, for example, by a conveyor belt from a previous station, and the articles 1 are collected in a row at a predetermined spacing at a collection station 2, which is defined at one end of the conveyor belt in the illustrated embodiment. The articles 1 are set in a stand-by state when collected at the collection station 2.

The caser also includes a blank sheet supply station 3 where a blank sheet magazine 4 storing a number of blank sheets 5 in the form of a stack is located. As well known in the art, a blank sheet is typically comprised of cardboard in a desired shape and it typically includes a central rectangular or square section, which will define the bottom of a box when the blank sheet has been folded in a predetermined manner, and a flap or side section at each of the four sides of the central rectangular or square section, which can be folded with respect to the central section. Blank sheets 5 may be supplied one by one from the magazine and one such blank sheet 5 is located at a receiving station. In one example, a vertically movable table (not shown) is located at the receiving station and the blank sheet 5 supplied from the magazine 4 is placed on the table when located at the receiving station.

Also provided in the caser is a holding and moving robot 6 which generally includes a main body 7, a first arm 8 which is pivotally connected to the main body 7, a second arm 9 which is pivotally connected to the free end of the first arm 8, and a holding head 10 mounted at the free end of the second arm 9. The main body 7 typically contains a controller for controlling the operation of the arms 8 and 9 and also the holding head 10. As well known in the art, the holding head 10 is so structured that it can temporarily hold selected portions, such as mouth portions, of the articles 1 while the articles 1 are moved from one location to another and then release them when the articles have been located at a desired location.

A folding station 11 is provided below the receiving station, and the blank sheet 5 is gradually folded into the shape of a box as it moves along a predetermined path defined in the folding station 11 as pushed by the holding head 10 of the holding and moving robot 6. Described more in detail, as well known in the art, a plurality of guide members may be provided in the folding station extending downward from the receiving station such that the flap sections of the blank sheet 5 are brought into contact with such guide members as it descends and gradually folded into the shape of a box to have the articles 1 enclosed therein as the blank sheet 5 is pushed downward along the predetermined path defined in the folding station 11. In this case, the support table (not shown) supports the blank sheet 5 thereon, which, in turn, supports the articles 1 thereon, so that the blank sheet 5 and the articles 1 are securely sandwiched between the support table and the holding head 10 during the descending motion along the folding station 11.

When the support table reaches the bottom of the folding station 11, the blank sheet 5 has been folded into the shape of a box so that the containers 1 are now enclosed in a box-shaped case with its top still open. A glue application and closing station 12 is defined downstream of the folding station 11 so that the glue is applied to selected portions of the box-shaped case and the box-shaped case is completely closed. Thereafter, the thus complete case enclosing the articles 1 therein is transported to a desired station.

In operation, the articles 1 are transported by a conveyor belt to the collection station 2 where the articles 1 are arranged in a predetermined format and set in a standby state. Then, the holding and moving robot 6 is activated to move the holding head 10 to the collection station 2 through a pivotal motion of the arms 8 and 9 to thereby hold the articles 1 in the collection station, for example, by grabbing selected portions, such as mouth portions, of the articles 1. On the other hand, a blank sheet 5 is supplied from the magazine 4 and placed on a support table (not shown) located at the receiving station. The holding and moving robot 6 is again activated to move its holding head 10 from the collection station to the receiving station so that the articles 1 temporarily held by the holding head 10 are also moved from the collection station to the receiving station. In this case, the articles 1 are located on a central rectangular section, which will later become a bottom of a box when folded, of the blank sheet 5 as illustrated in FIG. 1. It is to be noted that the arrangement of the articles 1 may be varied from one format to another during the movement from the collection station 2 to the receiving station as well known in the art.

Upon locating the articles 1 on the blank sheet 5 as described above, the holding head 10 then starts its descending motion along a predetermined path defined in the folding station 11. In one mode of operation, the second arm 9 is caused to pivot counterclockwise in accordance with a signal from the controller in the main body 7 so that the holding head 10 pushes the articles 1 and also the blank sheet 5 downward. Since the support table (not shown) supporting thereon the blank sheet 5 is provided to be movable along a predetermined path when pushed by the holding head 10, the blank sheet 5 and the articles 1 thereon move downward in unison. As they move, the flap or side sections of the blank sheet 5 come into engagement with the guide members (not shown) provided in the folding station 11 so that the flap or side sections of the blank sheet 5 are gradually folded into the shape of a box. Thus, when the blank sheet 5 reaches the bottom of the folding station 11, the flap or side sections of the blank sheet 5 have been folded to substantially enclose the articles 1 in a box with its top still open.

Then, the holding head 11 releases the articles 1 now contained in the box-shaped case and moves upward until it clears out of the folding station 11. Thus, the holding head 10 is now ready for next cycle of operation. On the other hand, the box-shaped case enclosing therein the articles 1 is now transported from the bottom of the folding station 11 to the glue application and closing station 12 where glue is applied and the flap or side sections are pressed together so that the box-shaped case is completely closed and discharged out of the caser.

In the above-described embodiment, the holding and moving robot 6 has been described to include the main body 7, first arm 8 and second arm 9. However, the present invention should not be limited to such a specific structure. As an alternative structure, the holding and moving robot 6 may include a columnar frame, a fixed support arm extending horizontally from the frame, an X-direction sliding member slidably mounted on the arm, and a Y-direction sliding member slidably mounted on the X-direction sliding member. And, the holding head 10 may be fixedly mounted on the Y-direction sliding member.

In this case, the horizontally extending arm is disposed to extend between the collection station 2 and the receiving station so that the X-direction sliding member may move between these stations. And, when the X-direction sliding member is located above the collection station, the Y-direction sliding member is caused to descend so as to allow the holding head 10 to temporarily hold the articles 1 in the collection station 2. Then, the Y-direction sliding member is moved upward to a desired level and then the X-direction sliding member is caused to move to the receiving station where the Y-direction sliding member is caused to move downward to locate the articles 1 on the central rectangular section of the blank sheet 5 and then to move both of the blank sheet 5 and the articles 1 on the blank sheet 5 along a predetermined path in the folding station 11.

Although not shown specifically, it should be understood that a main controller is also provided for synchronizing the operation of each of the components provided in the present caser. And, such a main controller is also associated with a controller provided in the main body 7 for controlling the operation of the holding and moving robot 6. The controller provided in the main body 7 may be integrated into the main controller, if desired.

While the above provides a full and complete disclosure of the preferred embodiments of the present invention, various modifications, alternate constructions and equivalents amy be employed without departing from the true spirit and scope of the invention. Therefore, the above description and illustration should not be construed as limiting the scope of the invention, which is defined by the appended claims.

What is claimed is:

1. A wrap around caser comprising:

a collection station for collecting articles, which are being transported by transporting means along a first predetermined path, in a predetermined arrangement, said collection station being defined at a predetermined location on said first predetermined path;

supplying means for supplying a plurality of blank sheets of predetermined shape to a receiving station one by one from a storing station storing a number of blank sheets, each of said blank sheets lying substantially flat horizontally when supplied to said receiving station, said receiving station being at least laterally spaced apart from said collection station; and holding and moving means for individually holding a predetermined number of two or more of said articles in a suspended manner at said collection station at the same time and moving said suspended articles along a path in the air and downward onto a predetermined portion of said blank sheet at said receiving station and then downward with said blank sheet to a bottom of a folding station located below said receiving station along a second predetermined path so as to have said blank sheet folded in a predetermined manner by a descending motion of said holding and moving means to have said articles wrapped by said blank sheet so folded as a carton box about sides of the articles with the so-folded carton box having an open top when reaching the bottom of said folding station while keeping said articles held by said holding and moving means until said articles reach the bottom of said folding stations, said holding and moving means being a single unit.

2. The caser of claim 1, wherein said holding and moving means includes a holding head capable of temporarily holding a selected portion of each of said articles.

3. The caser of claim 2, wherein said holding and moving means further includes a main body, a first arm pivotally mounted on said main body, a second arm pivotally mounted on said first arm, said holding head being fixedly mounted on said second arm.

4. The caser of claim 1, wherein said holding and moving means moves said articles in an essentially horizontal plane from said collection station to said predetermined portion of said blank sheet at said receiving station.

5. The caser of claim 1, wherein said holding and moving means holds said articles at a top portion of said articles.

6. A wrap around caser comprising:

a collection station for collecting articles, which are being transported by a conveyor along a first predetermined path, in a predetermined arrangement, said collection station being defined at a predetermined position on said first predetermined path;

a receiving station laterally spaced apart from said collection station;

a cardboard blank flat sheet supply magazine for supplying a plurality of blank sheets of predetermined shape to the receiving station in seriatim each of said blank sheets being received substantially flat horizontally in said receiving station;

a folding station located below and vertically extending from said receiving station; and a single-unit robot including a robot arm for individually holding each of a predetermined multiple number of the articles in a suspended manner at said collection station and for moving the held number of articles along a path in the air and downward onto a predetermined bottom portion of said blank sheet at said receiving station and then with said blank sheet bottom portion, downward to a bottom of the folding station along a second predetermined path so as to have said blank sheet folded in a predetermined manner by a descending motion of said robot arm and to have the number of the articles wrapped by said blank sheet so folded as an open top cardboard carton box about sides of the number of the articles when reaching the bottom of the folding station, without said robot releasing said articles until the number of the articles reach the bottom of the folding station.

* * * * *